United States Patent [19]

Stevko, Jr.

[11] 3,960,109

[45] June 1, 1976

[54] ELECTROSTATIC TONER TRANSFER

[75] Inventor: Phillip J. Stevko, Jr., Euclid, Ohio

[73] Assignee: Addressograph Multigraph Corporation, Cleveland, Ohio

[22] Filed: May 9, 1975

[21] Appl. No.: 576,124

Related U.S. Application Data

[62] Division of Ser. No. 457,071, April 1, 1974, Pat. No. 3,917,881.

[52] U.S. Cl. ..... 118/637

[51] Int. Cl.[2] ..... B05B 5/02

[58] Field of Search ..... 118/637; 96/1.4; 355/3 TR; 427/24

[56] References Cited

UNITED STATES PATENTS

| | | | |
|---|---|---|---|
| 3,658,519 | 4/1972 | Menz | 96/1.4 |
| 3,663,219 | 5/1972 | Takahashi | 96/1.4 |
| 3,781,105 | 12/1973 | Meagher | 355/3 TR |
| 3,830,589 | 8/1974 | Allen | 355/3 TR |
| 3,841,892 | 10/1974 | Krause et al. | 96/1.4 |

*Primary Examiner*—Ronald Feldbaum
*Attorney, Agent, or Firm*—Harry M. Fleck, Jr.

[57] ABSTRACT

A method of and apparatus for the transfer of toner particles from a developed photoconductor, or the like, to an object transfer surface by effecting charge flow between the photoconductor and the transfer surface, whereby the net electrostatic field acting upon the particles is reversed. The apparatus includes an insulating sheet provided with a conductive layer on the transfer object side. The insulating sheet is disposed between the photoconductor and transfer object and is apertured to permit the movement of toner particles to the object when the electrostatic field is reversed.

9 Claims, 6 Drawing Figures

ELECTROSTATIC TONER TRANSFER

This is a division of application Ser. No. 457,071 filed Apr. 1, 1974, now U.S. Pat. No. 3,917,881.

BACKGROUND OF THE INVENTION

The present invention is generally related to the transfer of images in both wet and dry type of image processing systems which utilize a recording member, such as a photoconductor, and toner particles for developing an image thereon.

The invention is particularly applicable to an addressing device for objects of varying physical characteristics and having some degree of transfer surface conductivity to receive the particle pattern. The invention will, therefore, be described with respect to this addressing purpose, although it will be appreciated that the invention has broader applications such as where voluminous objects of uniform characteristics, such as a stack of cards, are to receive image patterns transferred to their respective surfaces.

In the past, conventional techniques of developed image transfer have, for the most part, proven unsatisfactory, due in part to the physical properties of the transfer member and the environmental variables in which the transfer is performed. Factors such as temperature, pressure, and humidity can adversely affect the electrical characteristics of the transfer member, thereby causing a poor quality of transfer. Environmental variables are critical due in part to the fact that the transfer object acts as a capacitive storage medium during transfer. This is recognized in U.S. Pat. No. 2,807,233 to Fitsch, which mentions that a condenser is formed at the transfer station with the transfer web (object) serving as one of the dielectrics.

Each of the conventional transfer techniques required the use of an electrode, or the like, positioned behind the transfer member, such that the transfer member is sandwiched between the electrode and the insulating layer. Typically, the electrode takes the form of a roller, cylinder, plate, wire, or brush. High voltage is applied to the electrode to set up an electrical field through the transfer member, utilizing the electrostatic storage capacity of the transfer member to effect transfer of the toner particles.

Since such conventional transfer devices have required the use of a backup electrode, they are incapable of transferring a developed image to bulky or nonuniform items, such as boxes, magazines, and cartons. It is also apparent that such conventional devices are unable to effect transfer to the top or bottom sheet of a stack of paper, or the like, so as it would be impractical or impossible to position the electrode behind the respective sheet to which transfer is to be made.

The present invention provides a new and improved method and apparatus which overcomes all of the above referenced problems and provides a method of developed image transfer for bulky and nonuniform objects, as well as for stacks of uniform items, without the need for electrode backing and functionally independent of the bulk characteristics of the transfer object, in a manner which is simple, efficient and assures a perfect transfer.

SUMMARY OF THE INVENTION

In accordance with the present invention there is provided a method of and apparatus for transferring a developed image comprising electrostatically charged toner particles from an insulating surface to a transfer member having a transfer surface. By effecting conductive charge flow in the transfer member proximate to the transfer surface, the direction of the net electrostatic force on the developer particles is reversed, thereby separating the developed image from the insulating surface.

Further in accordance with the invention, the method includes interposing an apertured dielectric sheet between the transfer member and the image bearing surface so that a charge applied to the dielectric sheet forces conductive charge flow in the transfer member proximate to the transfer surface.

Still further in accordance with the invention, the method may include the application of vibration to the insulating surface after or during reversal of the direction of the net electrostatic force on the developer particles.

The invention also provides a device operating in the above fashion for transferring a pattern of electrostatically charged developer particles developed on an insulating layer, such as a photoconductor to a surface of a transfer member. The device includes a conductive base interfacing with the non-image side of the insulating layer and a sheet of plastic, or other dielectric interfacing, with the image side of the insulating layer and adapted to interface on the opposite side thereof, with the transfer member. The plastic sheet has a conductive layer bonded thereto and is provided with an aperture, or window, through which the toner particles pass from the insulating layer during transfer. The device is further provided with means such as a voltage source for selectively effecting conductive charge flow to the transfer member until the direction of the net electrostatic field acting on the toner particles is reversed to bond the toner particles to the transfer member.

Still further in accordance with the invention, the transfer device may include means for vibrating the insulating surface during or after the direction of the net electrostatic force on the developer particles has been reversed.

Another important object of the present invention is to provide a method and apparatus which assures a quality transfer independent of normal variations in humidity to which the transfer member is exposed during transfer.

DESCRIPTION OF THE PREFERRED EMBODIMENT

Figure 1:
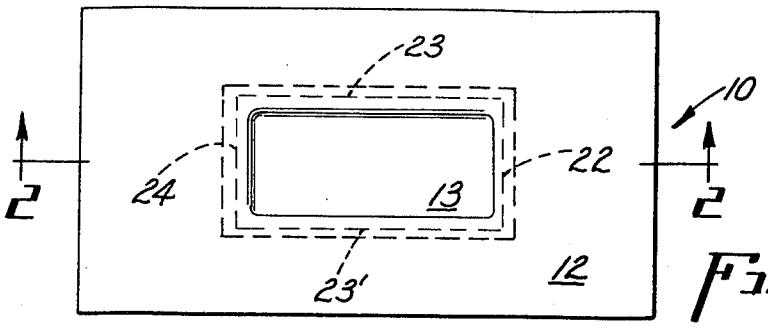
FIG. 1 is a plan view of a transfer object supported on a transfer assembly according to the present invention.
Figure 2:
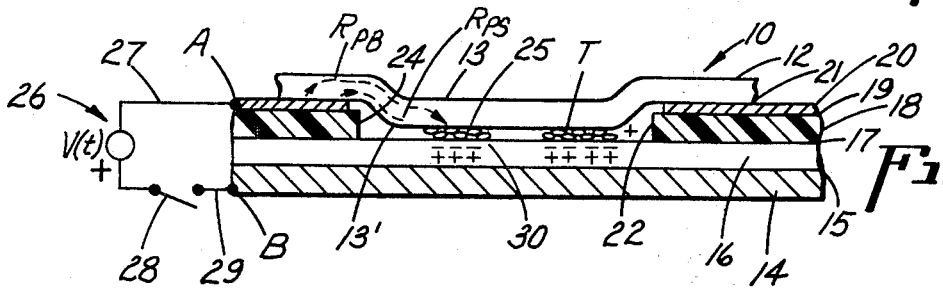
FIG. 2 is a partial cross-sectional view along section 2—2 of FIG. 1 including a source of transfer potential.

Referring now, more particularly, to FIGS. 1 and 2 of the drawings, a simplified embodiment of the transfer assembly of the present invention is generally indicated by the numeral 10 and is adapted to accommodate a transfer object, such as a sheet of paper 12. The central area of the paper overlies a transfer area or window generally indicated by 13. Basically, the transfer assembly is a structure of parallel conductive surfaces separated by a dielectric medium. A conductive member 14, typically of aluminum, defines a capacitor base plate which interfaces along a surface area 15 with an insulator 16, which in some image processing systems takes the form of photoconductor. A substrate of Mylar or other appropriate material (not illustrated) underlies conductive member 14 to insulate such. Layer 16 interfaces at a surface area 17 with a dielectric layer 18, of plastic or the like, which is capable of retaining an electrical surface charge. Preferably, layer 18 is of generally rectangular configuration, with an aperture or transfer window at area 13 bounded by edge walls 22, 23, 23′, and 24 shown in dash line in FIG. 1.

Of course, it is not intended that the present invention be limited to the illustrated configurations of the dielectric layer or associated aperture. Other configurations which define an opening for the transfer of toner particles from the insulation layer to the transfer object may be utilized and still provide satisfactory transfer in accordance with the method hereinafter described. Also, it is not intended that the present invention be limited to the relative thicknesses of the elements illustrated in the drawings or depth of the depression of the transfer member in the transfer window.

The thickness of insulation layer 16 should be uniform over interface surface area 15. If the insulator is a photoconductor, such as polyvinyl benzocarbazole (PVK), a thickness of approximately 2–15 micrometers provides satisfactory results. Either Mylar or Teflon (both trademarks of E. I. du Pont Co.) may be used for the dielectric layer 18, with a thickness of approximately 1–5 mils.

Dielectric layer 18 interfaces on surface area 19 with a thin conductive layer or film 20 which is preferably bonded to the dielectric layer, as in the case of aluminized Mylar. Preferably, conductive layer 19 is etched back from edge walls 22, 23, 23′ and 24 about ⅛ – ¼ inches to prevent arcing the insulator 16 of the transfer assembly. Arcing may also be prevented by providing a stack of two or more thin layers of dielectric, in lieu of the single layer indicated at 18, with each layer having a progressively larger aperture with respect to the underlying layer. The upper surface area 21 of conductive layer 20 interfaces with the lower surface of sheet 12 approximate to and surrounding the transfer surface area of the sheet defined by window 13. The toner particles which are electrostatically held to insulating layer 16 are denoted by the letter T in FIG. 2. Sheet 12 is somewhat depressed in the area of the transfer window, such that transfer surface area 13′ of the sheet comes into approximate contact with the toner particles C. Typically, the toner particles are comprised of a multiplicity of microscopically fine particles which are electrostatically attracted to the latent image on the surface of insulating layer 16. The processes by which the latent image pattern is developed on the insulating surface are well known to those skilled in the art of electrostatic image reproduction and it is not intended that the present invention be limited to any one particular type of image development.

Referring specifically to FIG. 2, it will be observed that a source of potential energy 26 is connected between conductors 20 and 14 at A and B by way of conductors 27, and 29, respectively. A switch 28, or other suitable means is provided for selectively connecting and disconnecting the energy source 26 to control the transfer process. Preferably, source 26 is a D.C. source of sufficient potential to effect the required charge flow between the conductors, as hereinafter explained.

Figure 3:
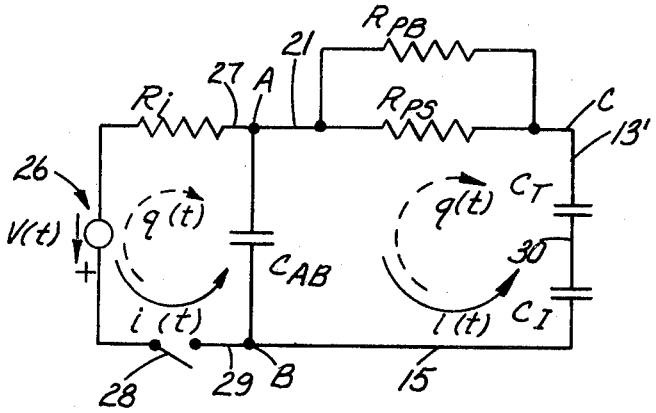
FIG. 3 is a schematic diagram of a lumped parameter, equivalent circuit representing the transfer mode of operation.

Referring now to FIG. 3, a schematic diagram is illustrated which is the equivalent circuit of the transfer assembly illustrated in FIGS. 1 and 2. The source of potential 26 is connected between points A and B as illustrated in FIG. 2. The internal resistance of source 26 is indicated in the equivalent circuit by resistor $R_I$ connected between source 26 and junction point A. A capacitor $C_{AB}$ is connected in the circuit between points A and B and represents the dielectric effect of insulating layer 16 and dielectric layer 18, together with air gaps at interfaces 15, 17 and 19. In practice, nearly all of the capacitance is attributable to the dielectric layer 18. The conductive characteristics of transfer object 12 are represented by parallel resistors $R_{PS}$ and $R_{PB}$. Resistor $R_{PS}$ corresponds to the effective surface resistance of the object between transfer surface area 13′ and conductive film 20 by way of interface 21. $R_{PB}$ is representative of the internal resistance of the transfer object between the transfer surface area 13′ and conductive film 20. In actual practice, the value of resistance $R_{PB}$ is significantly greater than $R_{PS}$ such that the path of charge flow is largely on the surface of the transfer object. Thus, for the purposes of analysis, $R_{PB}$ may be ignored in the equivalent circuit.

The circuit path continues in the opposite direction from transfer surface area 13′ through the area occupied by toner particles T and is completed through insulating layer 16 to conductor 14. In the equivalent circuit, $C_T$ represents the capacitance of the toner particles between surface area 13′ and interface 30. $C_I$ corresponds to the capacitance between the insulating layer 16 and conductor 14 along interface 15. The capacitance between the conductors 20 and 14 surrounding window 30 is represented by $C_{AB}$ in parallel with $C_I$ and $C_T$. In the preferred embodiment of the invention, $C_T$ is significantly less than $C_I$ and significantly greater than $C_{AB}$.

For the purposes of explanation, it will be assumed that the transfer assembly of the present invention utilizes toner particles of positive (+) charge. As such, insulating layer 16, which may be a photoconductor, is provided with a latent image pattern of negative (−) charge, such that the positively charged toner particles are attached thereto to provide a developed image pattern. With the insulating layer 16 having a negative charge on the upper surface thereof which receives toner particles, the lower surface will carry a corresponding positive (+) charge. This charge arrangement prior to transfer is illustrated in FIG. 2. Of course, if toner particles of a tive charge were to be utilized, the charge configuration would merely be reversed to assure attraction of the toner particle to insulating layer 16 during development.

As pointed out above, in order to achieve transfer, the net electrostatic field acting upon the toner particles is reversed. Prior to closure of switch 28 to initiate such transfer, capacitors $C_{AB}$, $C_T$ and $C_I$ in the equivalent circuit of FIG. 3 will carry charges as illustrated. Closure of switch 28 will cause a current to flow in the directions of the solid arrows illustrated in FIG. 3. Since such current flow is a function of time it is labeled as $i(t)$ the current which is a function time for charging the capacitor may be expressed by the equation:

$$i_2(t) = \frac{V(t)}{R} \epsilon^{-t/RC} \qquad \text{Equation (1)}$$

Where:

$R$ is the series combination $R_i + R_{PS}$;

$C$ is the series combination $C_TC_I/C_T+C_I$ and;

$\epsilon$ is the base of the natural logarithm

As mentioned above, $R_{PB}$ and $C_{AB}$ may be ignored in the equivalent circuit for the purpose of analysis. Also, since current flow by conventional standards is the flow of positive (+) charge, electron flow is in the opposite direction and is indicated by the dash line arrows labeled $q(t)$. This charge or electron flow may be expressed by the equation:

$$-Q_2(t) = CV(t)\ (\epsilon^{-t/RC} - 1\ ) \qquad (2)$$

Inspection of Equations (1) and (2) reveal that immediately upon closure of switch 28, there is a surge of current flow in the circuit. Eventually, this results in a negative charge build up on transfer surface area 13', thereby setting up an electric field of sufficient strength to cause toner particles T to be attracted to surface area 13'. The magnitude of potential energy source $V(t)$ necessary to transfer substantially all of the toner particles is a function of the relative thicknesses of insulating layer 16 and dielectric layer 18, considered with the ratio of the image pattern area to the total background surface area of the transfer window. Typically, the magnitude of $V(t)$ is in the range of several thousand volts D.C. It has been found that when utilizing a 5 mil aluminized Mylar window, 1.5 × 2.5 inches with peripheral interface dimensions of 9 × 12 inches, a PVK dielectric layer of 2–15 micrometers thickness, a magnitude of 6 thousand volts has provided satisfactory transfer results.

The magnitude of the transfer source can be arrived at empirically by observing the degree of transfer of the developed image of toner particles and varying the voltage accordingly until the most satisfactory transfer is achieved. It has been found that satisfactory transfer of toner particles is achieved when the charge on transfer surface area 13' is between 0.03–0.3 microcoulombs per sq. centimeter.

Figure 4:
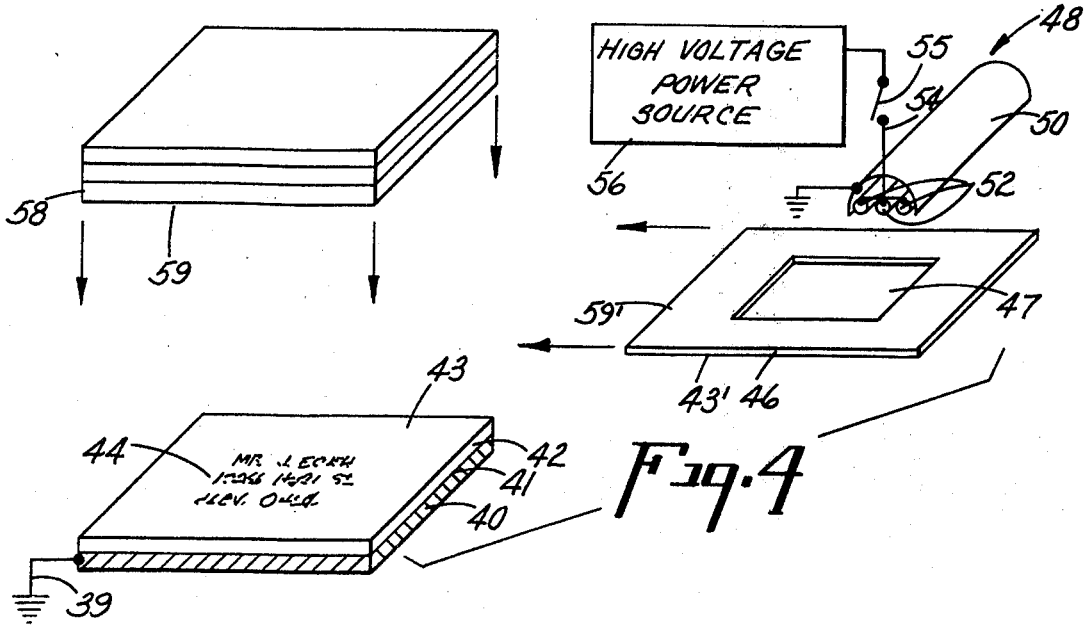
FIG. 4 is an exploded perspective view showing an alternative method of providing a transfer potential to a modified transfer assembly according to the present invention.

Referring now, more particularly, to FIG. 4 of the drawings, an alternate embodiment and method of the present invention are illustrated which utilize an isolated transfer source of potential energy to cause conductive charge flow in the transfer member. In the exploded view of FIG. 4, a conductive member 40 is grounded at 39 and interfaces over its surface area 41 with an insulator layer 42, of photoconductor for example, the opposite side of which has a surface area 43 with a developed image pattern of toner particles 44 defining an address. Vertically above the insulator layer 42 is a set of transfer objects 58, such as a stack of three cardboard surfaces, one positioned atop the other. Also suspended and withdrawn to the right of the insulator layer 42 is a sheet 46 of plastic, or other appropriate dielectric, having a window aperture 47 in the form of a rectangle centrally located therein. The plastic sheet 46 is adapted to be inserted between surface 43 of the insulating layer 42 and the interface surface area 59 of the bottom plane of the stack 58. The stack 58 is also adapted to move in the vertical plane in order to close the air gaps between the interface surface 59 and the interface surface 43, with the sheet 46 therebetween.

Supported from above the plastic sheet 46, while in its withdrawn position, is a corona discharge assembly 43, or corotron, used for charging a surface upon its energization by ionic bombardment as is well known to those skilled in the art of electrophotography. The corona assembly 48 includes a grounded metal chamber 50 within which are resident corona grid wires 52 which are adapted to be connected to a high voltage power source 56 through a switch 55 and power line 54. When the corona assembly is energized, a surface charge of uniform density is provided to sheet 46, which is a high resistive insulator of high permittivity and dielectric strength. Typically, this charge is in the range of 0.1–0.8 microcoulombs per sq. centimeter. The charge deposited on interface 59' of sheet 46 can be either positive or negative, depending upon the type of toner image processing being utilized.

Subsequent to each charging, sheet 46 is articulated toward the transfer assembly to a position on top of insulator layer 42, with window 47 encompassing the developed image pattern 44. The lowermost transfer article is brought into contact with sheet 46 by appropriate means, not illustrated. Since charged sheet 46 is a source of potential energy, charge is caused to flow in a manner similar to that described above, whereby the net electrostatic field acting upon the toner particle is reversed to effect transfer to the overlying transfer article. The transfer analysis described above with respect to FIGS. 2 and 3 applies likewise to the motive operation represented by FIG. 4. It will be appreciated that be effecting transfer in this manner, an entire stack of transfer objects, such as address a label, may be handled without the use of backup electrodes or other devices required with conventional transfer assemblies.

If desired, the transfer of the electrostatic developed image may be enhanced by disconnecting the ground 39 from conductive member 40 and connecting it to a source of potential energy having a polarity which causes a flow charge in a direction which aids the transfer. In other words the potential source would be connected between ground and conductive member 40 to cause a charge flow to reduce the charge on surface 43, such that the charge present on sheet 46 would more readily bring about a reversal of the net electrostatic field acting upon the toner particles. Transfer of the toner particles may also be aided by the application of vibrational energy to the insulator layer 42 in either the sonic or ultrasonic ranges as hereinafter explained.

Figure 5:
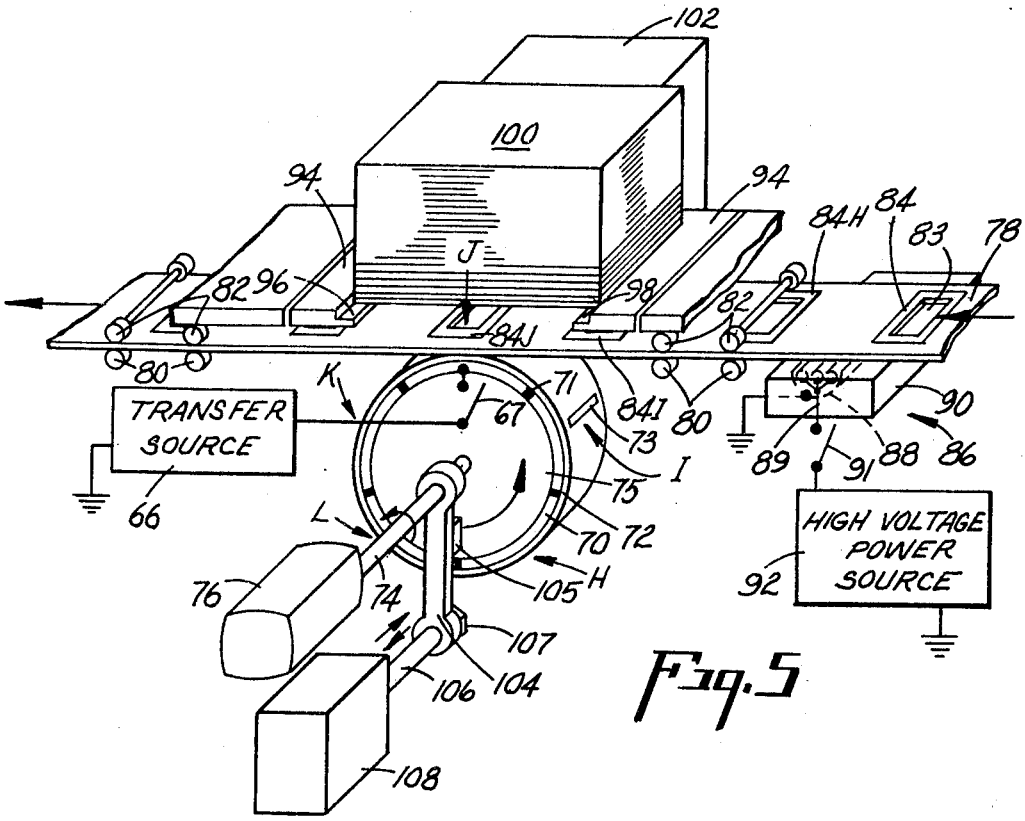
FIG. 5 is a somewhat diagrammatic perspective view of a cyclical machine assembly adapted to provide rapid multiple addressing employing the method illustrated in FIG. 4.

Referring now, more particularly, to FIG. 5 of the drawings, a diagrammatic illustration of an addressing machine utilizing the toner assembly and the methods described above is illustrated. The machine provides rapid addressing of a multiplicity of transfer objects 100, which may take the form of a stack of paper, cardboard, or bulky objects. A cylindrical drum 70 is comprised into five conductive sections separated from each other by insulators 71 and mounted to an insulator substrate 75 such as Mylar. The drum is provided with an insulating layer 72, such as a well known photoconductor. A plurality of conventional operating stations H, I, J, K and L are spaced around the circumference of drum 70, and a transfer source of potential 66 is provided which is adapted to be connected to the conductive drum layer 70 by way of a switch 67, or other means, to effect image transfer, as hereinafter explained.

Drum 70 is mounted to a drive shaft 74, which in turn is journalled for rotation and propelled in a counterclockwise direction by way of a drive motor and a gear box assembly 76. Assembly 76 is controlled in a manner to effectuate a sequence of operations, each operation occuring at one of the stations.

At drum station H, the latent image pattern is provided on insulating layer 72. This may be achieved by conventional exposure techniques if the insulating layer is a photoconductor. At station I, the latent image is developed, as indicated at 73, by electrostatically charged toner particles by well-known development techniques, such as cascading. It will be appreciated, that magnetic brush development, powder cloud development, or other development techniques may be used if desired.

At drum station J. the insulating layer carrying the developed image pattern is transferred to the surface of the transfer object which is in alignment therewith. An elongated web 78 of plastic or other suitable dielectric material extends in a horizontal plane tangent to the drum surface at station J. The web is provided with a plurality of longitudinally spaced windows 83, which are moved to the left in synchronism with the drum rotation, such that a new window is provided at the transfer station for each developed image presented by the drum. Preferably, web 78 is advanced by a plurality of feed rollers 80 and 82 which are positioned above and below the web on opposite sides of transfer station J. Of course, other appropriate drive means may be utilized, if desired. Each of the transfer windows 83 is provided with a conductive layer 84 defining a conductive window frame on the upper surface web 78, which makes contact with the transfer object during transfer at station J.

A corona assembly 86 is provided which is similar to the assembly 48 in FIG. 4, with the exception that the polarity of the ionic charge is opposite as the assembly serves to establish a surface charge on the opposite (lower) side of the dielectric layer. Included in the corona discharge assembly 86 is a grounded metal housing 88 which surrounds grid wires 89 connected to a high voltage power source 92 by way of a switch 91. The switch is controlled by appropriate means, not illustrated, to synchronize charge of the window frames with movement of web 78. The corona assembly 86 is shielded within an enclosure 90 having an upwardly facing opening 87 which confines the charge to the web to a small surface area occupied by a window frame. Each of the window frames is provided with a suffix corresponding to the various drum stations.

Supporting the stack of transfer objects 100 is a feed platform 94 with a pair of transfer feed rails 96 and 98 at opposite edges of the stack bottom. A control mechanism 102 controls feed of platform 94 with a reciprocating motion which lowers and then removes one layer from the bottom of stack 100 after transfer. Control mechanism 102 is also synchronized with a movement of web 78 such that the stack is not lowered until a window has been advanced to the transfer station J.

In order to aid in the transfer process, the addressing machine illustrated in FIG. 5 is provided with a source of vibrational energy 108 which imparts vibration to drum 70 by way of a hammer of coupling member 105 which engages the drum near one of its axial ends. A coupling arm 104 extends between a shaft 74 and a rod 106 associated with vibration source 108. A nut 107, or other locking member, fastens coupling arm 104 to rod 106 such that coupling arm 104 vibrates with rod 106. Vibrational source 108 is controlled by suitable means, not illustrated, such that the vibrations are timed with the transfer step at station J and will not adversely affect the operations occuring at the other drum stations. Preferably, the vibration operation takes place prior to application of the toner particles on the next image pattern at station I.

Subsequent to the transfer step at station J, drum 70 is rotated by drive assembly 76 in a counterclockwise direction until the image pattern is brought into alignment with station K. A light source, or other suitable means, is provided at station K for removing any remaining charge from the photoconductive insulator 72. Any one of several conventional techniques may be utilized to achieve this result and if desired a cleaner unit may be provided at this station.

Appropriate means, such as a corona discharge, is provided at station L for applying a uniform charge to the surface of insulating layer 72 in order to prepare such for accepting a new latent image pattern which is provided at station H by a suitable means such as exposure. As the drum is rotated further, stopping at each of the above-described stations, the process is repeated, as described above. It will be appreciated that the addressing machine described in FIG. 5 utilizes the basic principles of single-sided transfer described above and illustrated in FIGS. 1–3 and with dimensional constraints being approximately the same. It will also be appreciated, that by taking advantage of the fact that no backup electrode or similar device is required, the addressing machine of FIG. 5 is capable of handling a stack of transfer objects to provide an effective and efficient means of addressing each object at a very rapid rate not possible with machines that utilize conventional transfer techniques.

Figure 6:
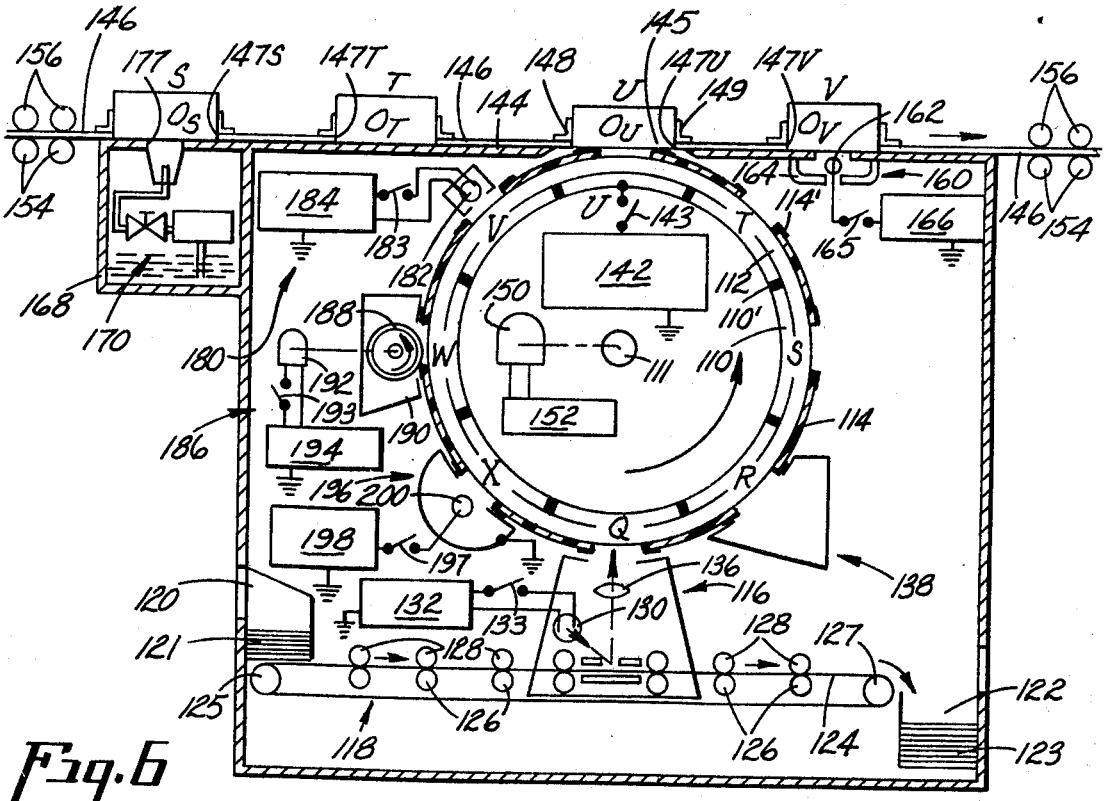
FIG. 6 is a diagrammatic elevational view of an automatic machine adapted to address bulky objects employing the method illustrated in FIGS. 1 and 2.

FIG. 6 is a diagrammatic illustration of a second automatic addressing machine utilizing the principles of the transfer assembly and method illustrated in FIGS. 1-3. This machine includes a plurality of object stations positioned in a horizontal plane and advanced in synchronism with a corresponding plurality of drum stations in accordance with appropriate control signals. A conductive drum 110 backed up by an insulator substrate (not illustrated) is journaled on a drive shaft 111 for counterclockwise rotation relative to various process stations spaced around the drum. The conductive drum 110 is divided into separate segments Q – X, insulated from each other by insulation strips 110'. A photoconductor layer 112, such as PVK photoconductive insulating material, is concentrically interfaced with conductive drum 110. It should be understood that this layer, and other components, are shown in exaggerated proportions for purposes of illustration.

Disposed concentrically about photoconductive layer 112 is an insulating dielectric layer 114 having high permittivity and dielectric strength capable of withstanding several thousand volts of applied potential difference. At each of the respective segments Q, R, S . . . W, X, there is a window formed in layer 114 of suitable dimensions for passing the pattern of developer particles formed in a latent image pattern on the surface of the insulating layer 112. The outermost surface of insulation layer 114 is preferably aluminized in the immediate area 114' surrounding each window to provide a conductive path to effect transfer as hereinafter explained. Each window frame 114' is preferably etched back from the window edges, as with the structure of FIG. 1 and is appropriately spaced from adjacent stations by an air gap or insulator to avoid charge conduction between stations. The dimensional constraints of the insulating and dielectric layers are the same as the structures illustrated in FIGS. 1–3.

Proximate and circumferentially complementing segment Q of the drum surface is an exposure assembly 116 interacting with a card transport apparatus 118. This Q shall be regarded as the reading station, while the station at U shall be regarded as the writing station or transfer station. A hopper 120 is filled with an input card deck 121 which feeds address information bearing cards to the transport apparatus 118 and thereby to the projector assembly 116 wherein an address is read onto station Q of the insulating layer 112 such as by a conventional photoconductive process. The cards continue on their journey through the projector apparatus 116 and drop into a stacker 122 to form an output stack of cards 123. The transport apparatus 118 includes a plurality of driven feed rollers in pairs 126, 128 and the transport web 124 cycles on cylindrical rollers 125, 127, respectively. The transport apparatus 118 is powered through the feed rollers 126, 128 by a motor and gear reduction (not shown) and is adapted to operate in synchronism with the drum station positions along with the object station positions associated with the drum mechanism. The card transport apparatus 118 is of the type which may be used with a picking apparatus for cards in order to provide selective addressing in a variety of applications now known.

The exposure assembly 116 includes a light ray projector 130 which is connected to a power source 132 by way of a switch 133, which in turn is operated by way of a logic circuit 152. Upon energization of projector 130, the address image is reflected to the light sensitive photoconductor layer 112 to selectively discharge the background and provide a latent image pattern. Preferably, the exposure assembly 116 is provided with appropriate optic means, such as lens 136, for focusing the image on the drum photoconductor layer.

The drum 110 is journaled for rotation on the drive shaft 111 which is powered by an electric motor and gear reducer 150. These elements are in turn controlled by logic circuit 152 adapted to synchronize the drum station rotation with the object station translation and the card transport translation. Subsequent to exposure, the drum 110 is rotated counterclockwise to a developer station 138. It is here that the latent image is developed by depositing triboelectrically charged toner particles on the charged latent image surface of the photoconductor 112. Many of the development techniques mentioned hereinbefore are also applicable. However, the powdered cloud technique finds favor here when the surface to be developed is somewhat restricted.

The upper side of a light tight enclosure 144 surrounding the drum 110 and associated apparatus is apertured at 145 so as to provide surface contact between a transfer object $O_U$ and the aluminized transfer interface of the concentric drum assembly during transfer. Aperture 145 is aligned with a similar aperture 147U in the transport web 146 which is of a flexible nature and allows a slight deflection into the enclosure station. Other web apertures are similarly numbered each with a prefix letter corresponding to one of the drum stations. Flexible guides 148, 149 are used at each object station in the web 146 to properly guide the transfer objects along their translational course. Feed rollers 154, 156 driven by a motor-reduction gear system controlled by the logic circuit 152 providing advancement of web 146.

After the transfer object $O_U$ is in position at station U and in surface contact with the aluminized Mylar drum surface 114, transfer occurs in accordance with the description relative to FIG. 2. A transfer voltage source 142 is applied as a source of transfer potential to the conductive segment U through the closure of a switch 143 by logic circuit 152. The electric field on the toner particles is reversed and the particulate image is electrostatically transferred to the lower surface of the object $O_U$ at this station.

The transport web 146 advances the objects, which may be boxes, books, cardboard members, or any of a variety of bulky items, from one object station to the next. Subsequent to transfer each object is advanced to object station V which is a developer fixing station for establishing a permanent pattern. A fixing assembly 160 includes a heating element 162 focused by a radiant shield 164 and supplied by a power source 166 through a switch 165. This arrangement transfers the radiant heat to the toner addressed surface of object $O_V$ in order to set the toner in a permanent image pattern. The power switch 165 is controlled by the logic circuit 152 to energize the radiant energy assembly 160 in a synchronized fashion with the process. It is not intended that fixing means be limited to this heating assembly since the insulating image systems fixing is accomplished by other means such as, but not limited to, pressure or chemical fixing.

Two steps removed from the transfer object station U in the upstream direction is an object station S which will be referred to as the atomizing station. A fluid reservoir 168 houses an appropriate atomizing assembly 170 which is controlled by the logic system 152 of the drum assembly. The atomized conductive fluid such as water is directed through an aperture 177 in the enclosure 168 and through the aligned aperture 147S in the transfer web 146 to enhance the surface conductivity over the transfer surface of the transfer object $O_S$. This improves the conductive transfer characteristics of the transfer objects particularly when the environmental humidity is significantly below normal levels. Of course, more refined approaches to atomizing moisture on the transfer surface may be utilized if desired.

The drum cycle of the mechanism illustrated in FIG. 6 is completed by counterclockwise rotation to a drum past a discharge station for reducing the latent image charge configuration in the photoconductive insulating layer 112. A discharge assembly 180 is provided, which includes a light source 182, connected to a power source 184 through a switch 183 controlled in synchronism with the drum by the logic circuit 152. The light source 182 is selectively energized by the closure of switch 183 when the particular latent image address is not be to used in a subsequent drum cycle, as would normally be the case. This reduction station V, however, is not energized in a drum cycle if another cyclic plan is substituted wherein the application involved requires image transfer of the same address to a number of objects.

A cleaning assembly 186 is provided at the next station including a rotating plush roller 188 journaled in a housing 190 which also serves to retain the residual particulate toner removed from the drum during the cleaning process. A motor 192 is powered from a source 194 through a switch 193 to rotate the roller 188 according to a command from the system logic 152.

Subsequent to cleaning each drum, station X segment is advanced to a corona discharge assembly 196. The corona assembly 196 includes a high voltage power source 198 connected to a grid electrode 200 through a switch 197 which is controlled from the system logic 152. A grounded shield 202 confines the ionic charge deposition to the photoconductive insulating surface 112 exposed at station X. The charging assembly 196 is selectively energized in order to provide a uniformly charged photoconductive surface 112 which receives a latent image pattern at the station X in the step subsequent thereto.

The invention has been described with reference to the preferred embodiments. Obviously modifications and alterations will occur to other upon reading and understanding of this specification. It is our intention to include all such modifications and alterations insofar as they come within the scope of the appended claims or the equivalents thereof.

What is claimed is:

1. A device for transferring a pattern of electrostatically charged developer particles, bound in an image pattern to an image surface of an insulating member by an electric field, to a transfer surface of a transfer member, said device comprising:

a conductive base interfacing with a non-image surface of the insulating member;

a dielectric member adapted to interface on one side thereof with the image surface of the insulating member;

a conductive layer disposed on the opposite side of said dielectric member and adapted to interface with a portion of the transfer surface of the transfer member;

said dielectric member and associated conductive layer each having an aperture in general alignment with the image pattern of developer particles on the insulating surface prior to transfer;

means for bringing the transfer surface into engagement with said conductive layer; and means for causing reversal of the direction of the net electric field acting on the developer particles to effect an electrostatic bond between the developer particles and the transfer surface.

2. The device set forth in claim 1 wherein said field reversal means includes means for causing conductive charge flow between the transfer member via said conductive layer and said insulating member via said conductive base.

3. The device set forth in claim 2 wherein said conductive charge flow means effects charge flow after said dielectric member is interposed between the transfer surface and the image surface.

4. The device set forth in claim 3 wherein said conductive charge flow means comprises a source of electric potential selectively connected between said conductive layer and said conductive base.

5. The device set forth in claim 1 wherein said field reversal means includes means for producing a surface charge on said dielectric member prior to bringing said conductive layer into engagement with the transfer surface.

6. The device set forth in claim 5 wherein said surface charge causes an electric field opposed to the field binding the particles to the image surface.

7. The device set forth in claim 1 wherein the transfer member is of unlimited bulk.

8. The device set forth in claim 1 wherein the insulating member is defined at least in part by a photoconductor.

9. The device set forth in claim 8 wherein the apertures of said dielectric member and said conductive layer are of similar configuration and substantially aligned with each other.

* * * * *